US008534198B2

(12) United States Patent
Matthys

(10) Patent No.: US 8,534,198 B2
(45) Date of Patent: Sep. 17, 2013

(54) LOCOMOTIVE ENGINE ENCLOSURE AND METHOD FOR SERVICING LOCOMOTIVE ENGINE

(75) Inventor: Hector Matthys, Peoria, IL (US)

(73) Assignee: Progress Rail Services Corp, Albertville, AL (US)

( * ) Notice: Subject to any disclaimer, the term of this patent is extended or adjusted under 35 U.S.C. 154(b) by 259 days.

(21) Appl. No.: 13/170,430

(22) Filed: Jun. 28, 2011

(65) Prior Publication Data

US 2013/0000508 A1 Jan. 3, 2013

(51) Int. Cl.
*B61C 17/00* (2006.01)

(52) U.S. Cl.
USPC ..... 105/26.05; 105/35

(58) Field of Classification Search
USPC ..... 105/26.05, 35, 38, 62.1, 49, 50
See application file for complete search history.

(56) References Cited

U.S. PATENT DOCUMENTS

| | | | | |
|---|---|---|---|---|
| 3,868,908 | A * | 3/1975 | Pelabon | 105/1.4 |
| 4,186,665 | A * | 2/1980 | de Jong et al. | 105/456 |
| 4,696,361 | A | 9/1987 | Clark et al. | |
| 5,535,680 | A * | 7/1996 | Bieber | 105/397 |
| 5,669,311 | A * | 9/1997 | Hill et al. | 105/62.2 |
| 5,673,627 | A * | 10/1997 | Bieber et al. | 105/329.1 |
| 6,092,616 | A | 7/2000 | Burris et al. | |
| 6,591,758 | B2 * | 7/2003 | Kumar | 105/35 |
| 7,430,967 | B2 * | 10/2008 | Kumar | 105/35 |
| 7,565,867 | B2 | 7/2009 | Donnelly et al. | |
| 7,770,525 | B2 * | 8/2010 | Kumar et al. | 105/51 |
| 7,966,945 | B1 * | 6/2011 | Miller et al. | 105/49 |
| 7,971,538 | B1 * | 7/2011 | Miller et al. | 105/50 |
| 8,381,658 | B1 * | 2/2013 | Miller et al. | 105/50 |
| 2009/0101041 | A1 | 4/2009 | Burns et al. | |
| 2010/0071584 | A1 | 3/2010 | Smith, Jr. et al. | |
| 2010/0170414 | A1 | 7/2010 | Hardin et al. | |
| 2012/0160124 | A1 * | 6/2012 | Barbee et al. | 105/35 |
| 2013/0000508 | A1 * | 1/2013 | Matthys | 105/35 |

FOREIGN PATENT DOCUMENTS

| | | | |
|---|---|---|---|
| GB | 455234 | A | 10/1936 |

* cited by examiner

*Primary Examiner* — Jason C Smith
(74) *Attorney, Agent, or Firm* — Leydig, Voit & Mayer

(57) ABSTRACT

A locomotive includes an engine compartment having two sidewall structures and inboard and rear end structures defining an engine enclosure. A top hatch cover a top opening of the enclosure, which houses an engine. A removable cap being generally box-shaped extends across a portion of the top opening adjacent the top hatch and also across a portion of each of the two sidewall structures. An engine pit opening is exposed when removable cap is removed. The engine pit opening is sufficiently large to accommodate lifting the engine out of the enclosure. The engine pit opening is partially defined by two side edges extending parallel to the centerline along sidewall structures, each of the two side edges being disposed at a clearance height that is lower than an overall height of the engine compartment.

20 Claims, 9 Drawing Sheets

LOCOMOTIVE ENGINE ENCLOSURE AND METHOD FOR SERVICING LOCOMOTIVE ENGINE

TECHNICAL FIELD

This patent disclosure relates generally to diesel-electric locomotives and, more particularly, to an engine enclosure for a locomotive.

BACKGROUND

Diesel-electric locomotives traditionally employ a high power diesel internal combustion engine to rotate an electric generator, which in turn provides electric power to drive the locomotive's fraction motors and to power other components. In a so-called line haul locomotives, the desired acceleration and pull force required to move rolling stock and cargo weighing hundreds of tons requires a large amount of power. For this reason, the diesel engine in a line haul locomotive often has a rated power output exceeding 4,000 brake horsepower (bhp).

Large diesel engines perform well in terms of emissions and fuel efficiency at or near the rated power output. But the duty cycle typically experienced by a line haul locomotive also requires the engine to idle for long periods of time or maintain low train speeds, which results in the diesel engine often operating at a low power output. During operation in low power output modes, the large diesel engine is relatively less effective in terms of emissions and fuel efficiency.

Several locomotive manufacturers in the U.S. have begun to commercialize new locomotives which are powered by multiple diesel engines. For instance, multi-engine "genset" locomotives have been developed for use in so-called switcher locomotive applications. Switcher locomotives are typically used in a rail yard to move cars around when assembling and disassembling trains. The relatively recently commercialized switcher locomotives are called genset locomotives because each engine is connected to device a respective electric generator. The multiple engines are typically mounted together on a separate frame as an independent power pack in a fashion similar to a generator set used in backup power or remote power applications. Each genset is individually mounted to the locomotive deck. Genset locomotives can have two to four separate power packs, which may be identical to one another or which may include a larger engine in combination with one or more smaller engines. Having multiple engines allows the operation of just a single engine during idling and low power output. The relatively small, single engine operated during low power output can operate more efficiently than a very large diesel engine at that same power output. A low power output will be a much higher percentage of the rated power of a small engine than it would be for a very large engine, and efficiency is generally a function of the percentage of rated power output. When the locomotive requires high power output, all of the engines can be operated simultaneously to produce maximum power. Thus, with the application of multiple engines, it is possible to reach a new compromise for locomotive propulsion where power can be provided almost as effectively, in terms of emissions and fuel efficiency, at low power output as at high power output.

The use of multiple engines and alternators in a single locomotive, however, creates a challenge for packaging of all the different components into the locomotive's engine compartment. Moreover, the dense packaging of engine and other locomotive components within the engine compartment creates challenges when attempting to access various components for repair and service.

SUMMARY

The disclosure describes, in one aspect, a locomotive. The locomotive includes a frame having a longitudinally extending centerline. The frame is supported by two trucks having traction motors associated therewith, which are operable to drive one or more wheels configured to engage a railroad. An engine compartment has two sidewall structures extending parallel to the centerline, an inboard end structure and a rear end structure, which extend perpendicular to the centerline. An engine enclosure is defined between the frame, the two sidewall structures, and the inboard and rear end structures. At least one top hatch is connected to the engine compartment and disposed to cover a top opening of the engine enclosure. At least one engine connected to a generator is disposed within the engine enclosure. The generator is configured to provide electrical power to the traction motors. A removable cap is generally box-shaped and extends across a portion of the top opening of the engine enclosure adjacent the at least one top hatch and across a portion of each of the two sidewall structures. An engine pit opening is defined in the engine enclosure and exposed when the removable cap has been removed. The engine pit opening is sufficiently large to accommodate the at least one engine being lifted out of the engine enclosure through the engine pit opening. The engine pit opening is further defined by two side edges extending parallel to the centerline along the sidewall structures, each of the two side edges disposed at a clearance height that is lower than an overall height of the engine compartment.

In another aspect, the disclosure describes an engine compartment for housing one or more engines of a machine. The engine compartment includes two sidewall structures extending parallel to a longitudinal centerline of the engine compartment. An inboard end structure and a rear end structure extend perpendicular to the centerline. An engine enclosure is defined between the frame, the two sidewall structures, and the inboard and rear end structures. At least one top hatch is disposed to cover a top opening of the engine enclosure. At least one engine is disposed within the engine enclosure. A removable cap that is generally box-shaped extends across a portion of the top opening of the engine enclosure adjacent the at least one top hatch and across a portion of each of the two sidewall structures. An engine pit opening is defined in the engine enclosure and exposed when the removable cap is removed. The engine pit opening is sufficiently large to accommodate the at least one engine being lifted out of the engine enclosure through the engine pit opening. The engine pit opening is further defined by two side edges extending parallel to the centerline along the sidewall structures, each of the two side edges disposed at a clearance height that is lower than an overall height of the engine compartment.

In yet another aspect, the disclosure describes a method for servicing a locomotive engine. The method includes removing one or more top hatches of an engine compartment of the locomotive, and disconnecting and removing various components of the locomotive that are installed on a top portion of the engine compartment. An engine pit opening is exposed through a top of the engine compartment. The engine pit opening has sufficient clearance to allow the lifting and removal of a locomotive engine from the engine compartment. The engine pit opening is at least partially defined by two side edges extending parallel to a centerline of the locomotive, each of the two side edges being disposed at a clearance height that is lower than an overall height of the engine compartment. The locomotive engine is disconnected from other components and systems of the locomotive, and is then lifted and removed from the locomotive through the engine pit opening.

DETAILED DESCRIPTION

This disclosure relates to locomotives having one or more engines associated therewith. More particularly, the disclosure relates to a cooling system for locomotives that is configured to be removed such that access is provided for engine service or replacement. While the arrangements in accordance with alternative embodiments are illustrated in connection with a locomotive, the arrangements disclosed herein have universal applicability in various other types of machines as well. The term "machine" may refer to any machine that performs some type of operation associated with an industry such as mining, construction, farming, land or marine transportation, mobile or stationary power generation or any other industry known in the art. For example, the machine may be an earth-moving machine, such as a wheel loader, excavator, dump truck, backhoe, motor grader, material handler or the like. Moreover, mobile or stationary electrical power generation machines, such as gensets, may be used.

Figure 1:
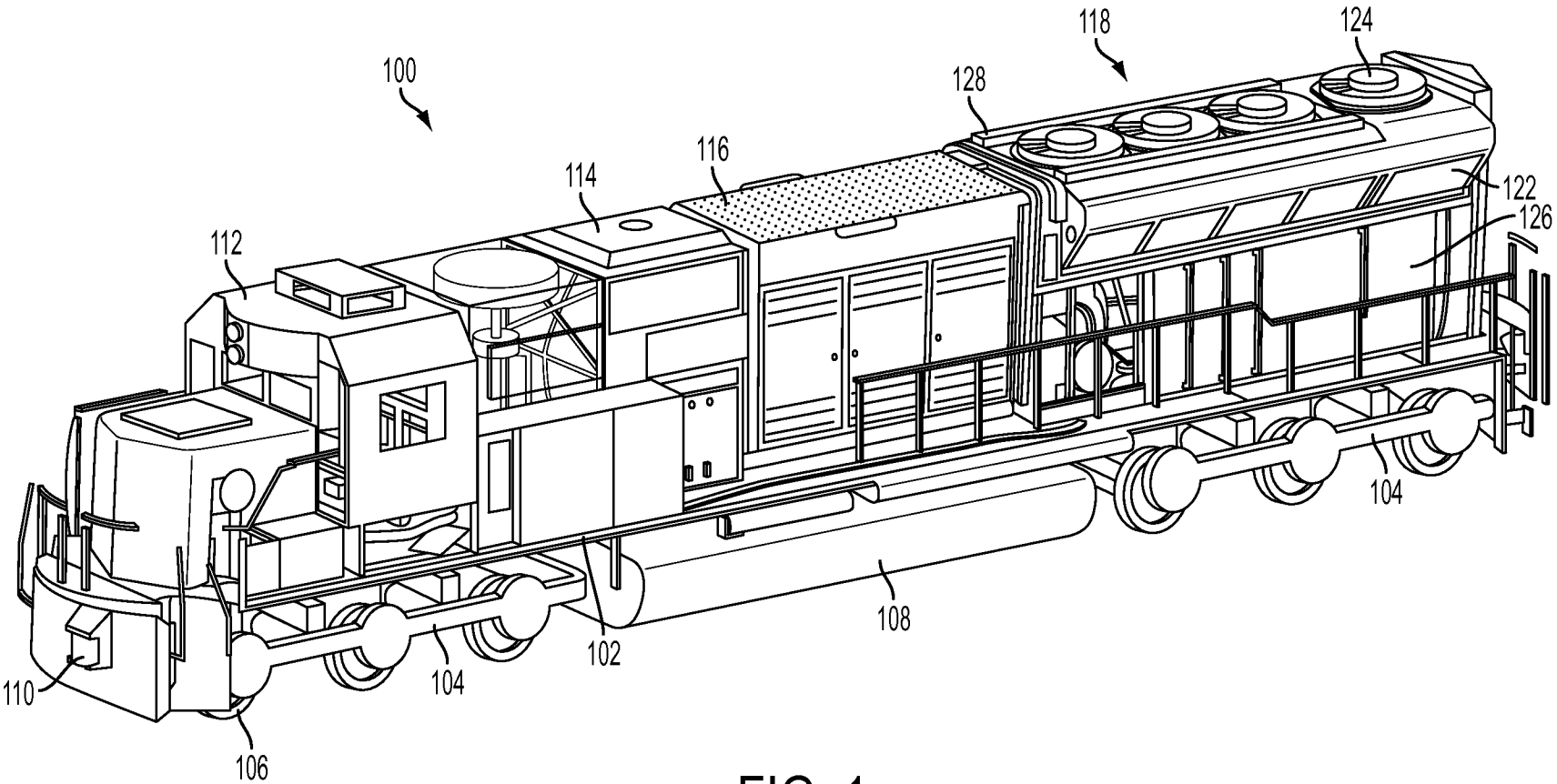
FIG. 1 is a perspective view of a locomotive in accordance with the disclosure.

A locomotive 100 is shown in FIG. 1. In the illustration of FIG. 1, an exemplary locomotive is shown but other types of locomotives are also contemplated. The locomotive 100 includes a frame 102 supported by two truck assemblies 104. Each truck assembly 104 is pivotally connected to the frame 102 and includes three wheel axles 106, each of which is powered by an electric traction motor (not shown) as is known. The frame 102 also includes a fuel tank 108 and couplers 110 disposed on either end.

On a top side, the frame 102 includes an operator compartment 112 disposed adjacent an electrical switchgear compartment 114 that houses various electrical power distribution and transformation components (not shown). An generator compartment 116 houses a main generator (not shown), which is arranged to provide DC electrical power to drive the traction motors. An engine compartment 118 is disposed adjacent the generator compartment 116. The engine compartment 118 includes at least a large diesel engine (not shown) connected to the generator, and a genset having a smaller diesel engine. Radiators 120 that are convectively cooled by an airflow provided by fans 122 are disposed on the upper portion of the engine compartment 118.

Various access panels or doors 126 are provided along the sides of the engine compartment 118 to provide access to the engines for service. However, certain engine service operations may become time consuming or may even be impossible to perform by the relatively limited access to internal components provided through the doors 126. Accordingly, alternative access to the engines within the engine compartment 118 would be beneficial to the speed and the ability to service the engines.

Figure 2:
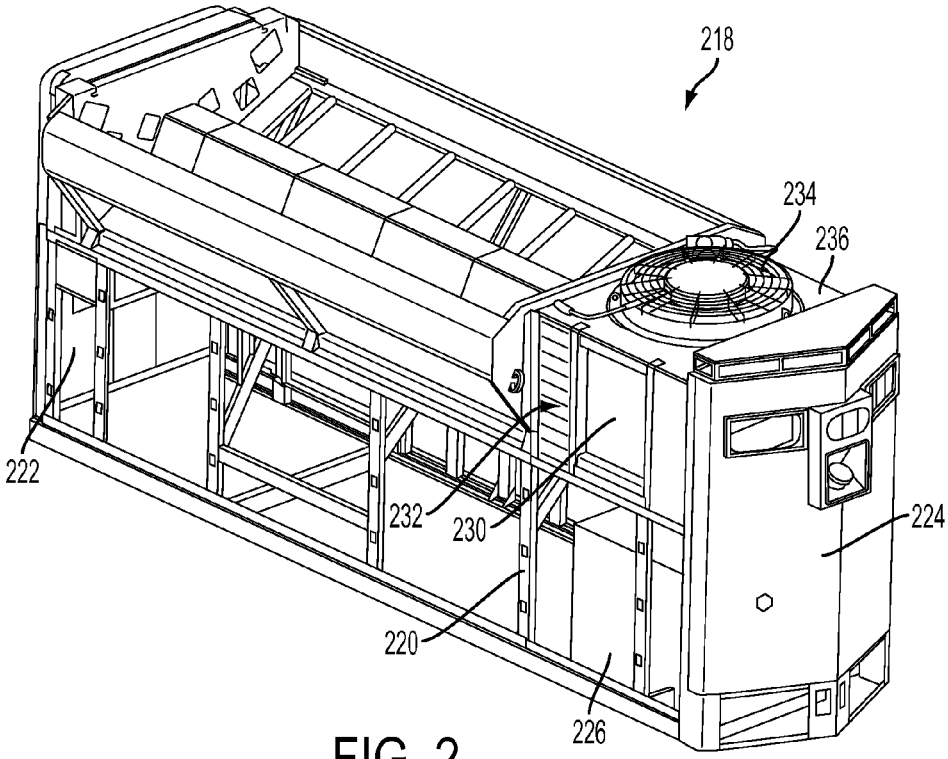
FIG. 2 is a partially disassembled view of portion of a locomotive's engine compartment in accordance with the disclosure.
Figure 3:
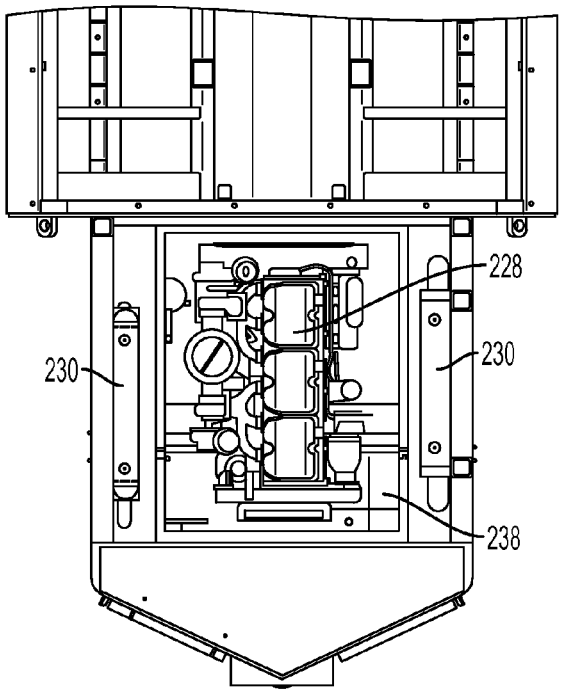
FIG. 3 is a top view of a locomotive engine installed in a compartment in accordance with the disclosure.

A first embodiment of an engine compartment 218 configured to provide easy access to the engines of the locomotive 100 is from a side perspective in FIG. 2 and from a top perspective in FIG. 3. Certain components, such as the doors 126 and top hatches 128 have been removed, and certain components such as the larger of the two diesel engines has been omitted in the illustrations of FIG. 2 and FIG. 3 for clarity. In reference to FIG. 2, the engine compartment 218 includes two sidewall structures 220, an inboard end structure 222 and an end structure 224. A genset 226 includes an engine 228 and a generator 229 (generator shown in FIG. 9). The generator connected to engine 228 has been omitted from the illustrations, but its positioning and operable association with engine 228 is well known in the art. For example, the genset 226 may be a C18 genset manufactured by Caterpillar, Inc. of Peoria, Ill.

The engine 228 may be an inline-6 cylinder, water cooled diesel engine. Cooling water circulating through the engine 228 during operation is provided to radiators 230 that are disposed along the sides of a cooling enclosure 232. During operation, air is drawn into the cooling enclosure 232 through the radiators 230 by a fan 234, which then expels the air through the top side of the enclosure 232. The fan 234 is installed in a top hatch 236.

Turning now to the illustration of FIG. 3, the fan 234 and top hatch 236 have been removed to expose an engine pit opening 238. From this top view, it can be seen that the engine pit opening 238 is sufficiently long and wide to permit the vertical lifting of the engine 228 out of the engine compartment 218. In this way, when requiring service of the engine 228 that would otherwise be hindered by the structures surrounding the engine 228 within the engine compartment 218, the engine 228 may be disconnected from the various mechanical, electrical and fluid connections. Thereafter, the electrical connections to the fan 234 may be severed and the top hatch 236 removed to expose the engine 228 through the engine pit opening 238. With the engine disconnected and exposed, the engine 228 may be simply lifted by an overhead crane (not shown), serviced, and reinstalled or replaced by a standby unit. In this way, service and maintenance of the locomotive 100 may be expedited.

Figure 4:
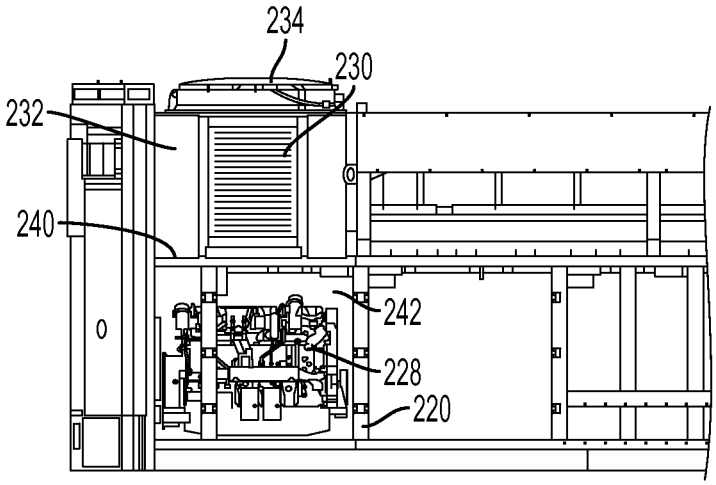
FIG. 4 is a side view and FIG. 5 is a partially disassembled perspective view of a portion of the engine compartment of a locomotive in accordance with the disclosure.
Figure 5:
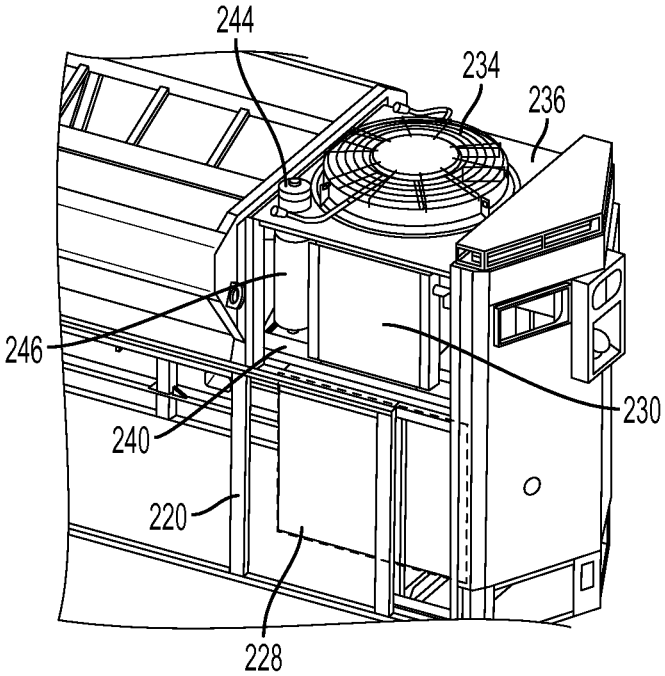

In reference now to FIG. 4, which is a partial section view of the engine compartment 218, and to FIG. 5, which has certain panels removed, additional and optional structures may be seen. In reference to FIG. 4, an intermediate hatch 240 can be seen extending horizontally between an engine enclosure 242 and the cooling enclosure 232. The intermediate hatch 240, when one is installed, covers substantially the entire engine pit opening 238 (FIG. 3) and is removed to provide access to the engine 228. When installed, the intermediate hatch 240 provides a barrier for convective heating of the cooling enclosure 232 and the various components found therein from heated air wafting from the engine 228 during operation.

In reference to FIG. 5, an optional exhaust stack 244 is shown that extends through both the intermediate hatch 240 and the top hatch 236 to expel exhaust gas during operation of the engine 228. As shown, a pipe that includes a muffler 246 extends vertically upward through aligned openings in the hatches 236 and 240. When the stack 244 is installed, optional seals to prevent air at different temperatures mixing between the engine enclosure 242 and the cooling enclosure 232 may be used at the stack openings formed in the hatches 236 and 240.

When the embodiment of an engine compartment 218 is used, as shown in FIGS. 2-5, a service procedure to remove and/or replace the engine 228 from the engine enclosure 242 may be carried out by first disconnecting the electrical connections to the fan 234, the fluid connections to the radiators 230 and, if installed, the gas connections to the stack 244. Thereafter, the top hatch 236 along with the fan 234 can be removed, followed by the removal of the intermediate hatch 240 to expose the engine 228 from the top through the engine pit opening 238. Thereafter, the engine may be disconnected from the locomotive 100 and withdrawn from the locomotive 100 by an overhead crane (not shown). This procedure is advantageous because it provides unhindered access to the components of the engine 228 after it has been removed, and represents an improvement over the limited access afforded through the door openings in the sidewall structures 220 while the engine 228 is still connected in the engine enclosure 242.

Figure 6:
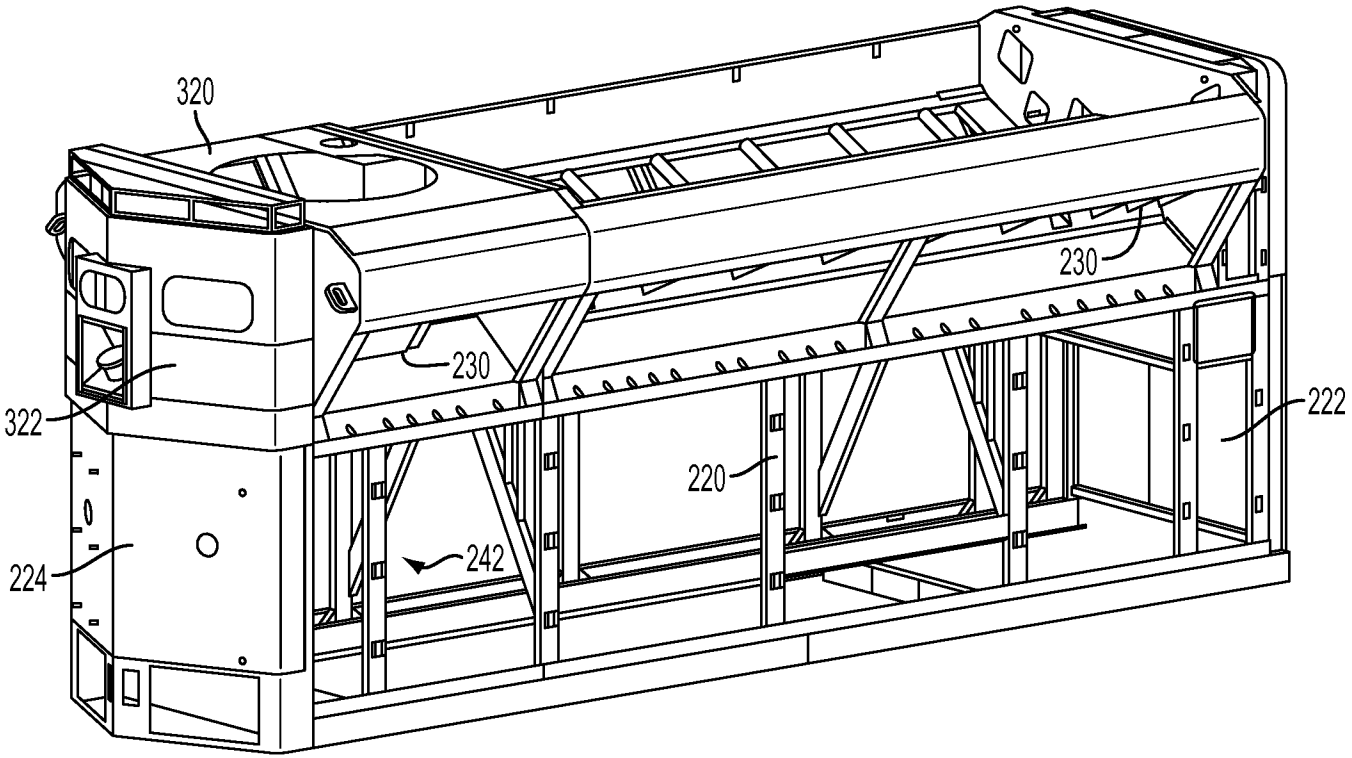
FIG. 6 is a perspective view of the engine compartment for an alternative embodiment of a locomotive in accordance with the disclosure.

In the description that follows, structures and features that are the same or similar to corresponding elements and features already described are denoted by the same reference numerals as previously used for simplicity. Accordingly, an alternative embodiment of an engine compartment 318 is shown in FIG. 6. The engine compartment 318 includes sidewall structures 220, an inboard end structure 222 and an end structure 224. In this embodiment, the end structure 224 is considerably shorter than the corresponding structure shown in FIG. 2 in that a portion of the end structure 224 is defined on a removable cap 320 that covers the engine enclosure 242.

Figure 7:
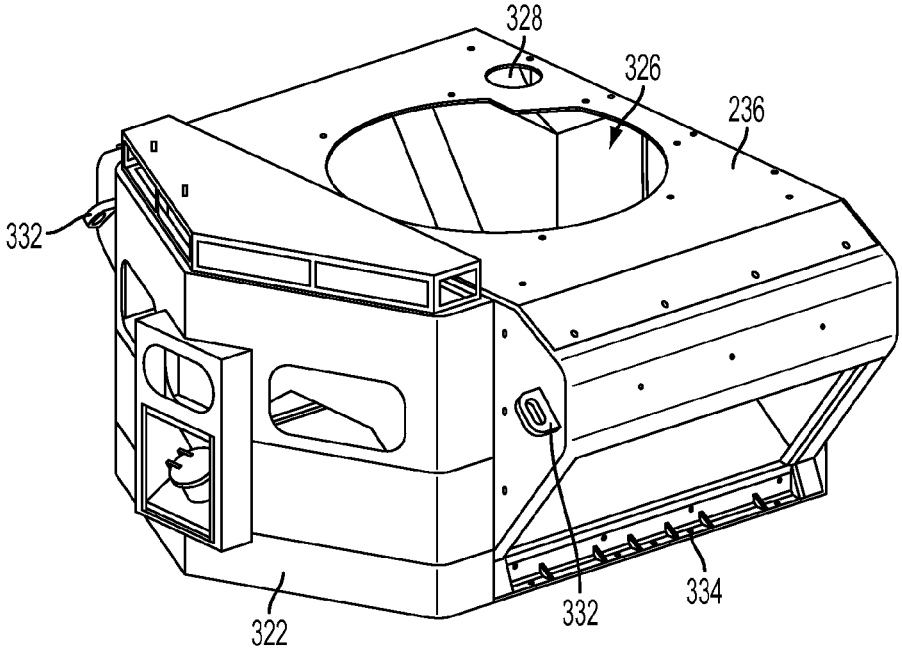
FIGS. 7 and 8 are views from different perspectives of a removable cap for a locomotive in accordance with the embodiment shown in FIG. 6.
Figure 8:
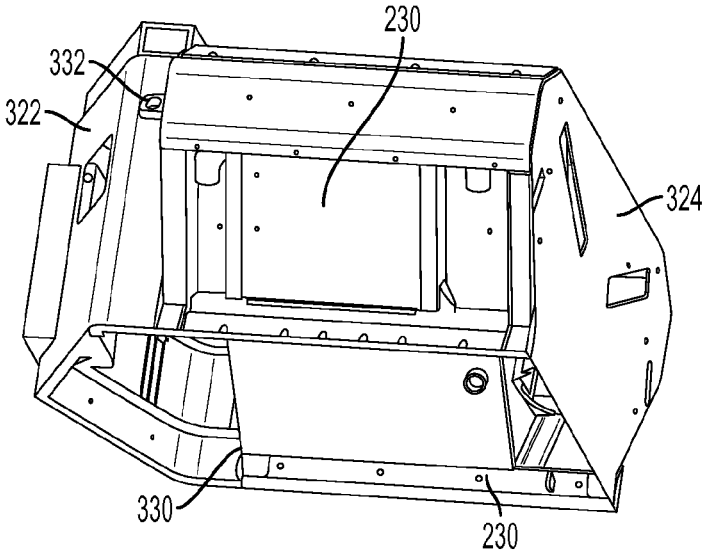

The removable cap 320, which is best shown from different perspectives in FIGS. 7 and 8, includes a rear structure portion 322 that forms part of the rear structure profile of the locomotive when the cap 320 is installed as part of the engine compartment. The removable cap 320 further includes an inner structure plate 324 that mates with the remaining engine compartment and two radiators 230 disposed at angle that follows the profile of the radiators 230 of the main engine, as shown in FIG. 6. The removable cap 320 has a generally rectangular cuboid or box shape. A fan opening 326 is configured to accommodate the fan 234 (FIG. 5), and an exhaust stack opening 328 accommodates the exhaust stack 244 (FIG. 5). The removable cap 320 further includes inclined heat shields 330 that substantially isolate the radiators 230 from heated air that rises from the engine 228 during operation.

Figure 9:
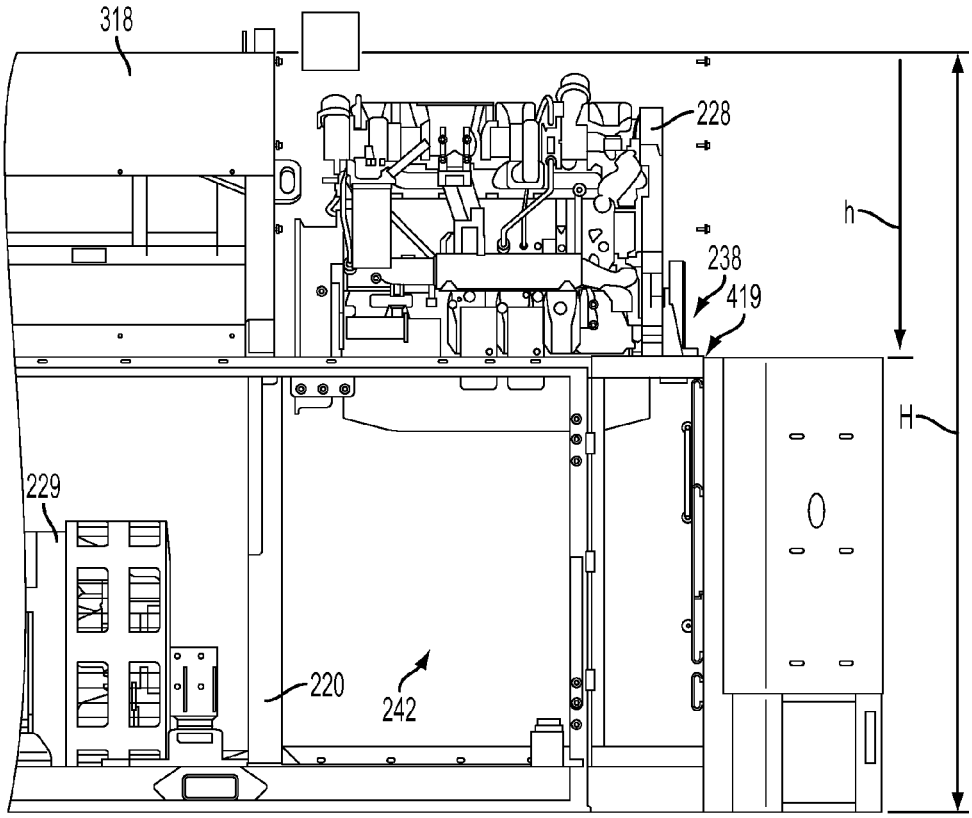
FIG. 9 is a partially disassembled view of a locomotive during an engine extraction or installation process in accordance with the disclosure.

From a functional standpoint, the removable cap 320 supports the fan 234 and radiators 230 in a fashion similar to the engine compartment 218 and hatches 236 and 240 discussed previously relative to the embodiment shown in FIGS. 2-5. However, the incorporation of a removable rear structure portion 322 of the rear structure 224 facilitates the removal of the engine 228 from the engine enclosure 242. More specifically, as best shown in FIG. 9, the engine 228 can be lifted from the engine enclosure 242 through the engine pit opening 238, which has edges 419 extending along the sidewalls of the engine enclosure that are disposed at a clearance height, h, which in the illustrated embodiment is about 40% lower than a total height, H, of the engine compartment 318. In this way, the locomotive 100 may be more easily serviced in facilities having lower overhead cranes or overhead work clearance. In the illustration of FIG. 9, the engine 228 is shown in a partially withdrawn position as it passes through the engine pit opening 238.

When lifting the removable cap 320 from the locomotive 100, overhead crane cables (not shown) can be connected to lift points 332 and lift the removable cap 320 after the appropriate electrical, fluid and gas connections have been disconnected as previously discussed. When the removable cap 320 is installed onto the locomotive 100, it may be secured thereto by use of any appropriate means, such as threaded fasteners passing through openings 334. A rectangular cuboid or box space that is open at least on the sides and top of the engine enclosure 242 permits access to remove the engine 228 from the engine enclosure 242 while also reducing the clearance height that the engine must be lifted to clear the locomotive.

An alternative embodiment for an engine compartment 418 is shown in FIGS. 10-13. In this embodiment, structures or features that are the same or similar to corresponding structures and features previously described are denoted by the same reference numerals previously used for simplicity. The engine compartment 418 includes sidewall structures 220, an inboard end structure 222 and an end structure 224. Unlike the engine compartment 318 as shown, for example, in FIG. 6, the end structure 224 of engine compartment 418 is similar to the end structure of engine compartment 218 as shown in FIG. 2. In other words, the end structure 224 has a length comparable to the overall height of the engine compartment 418.

Figure 10:
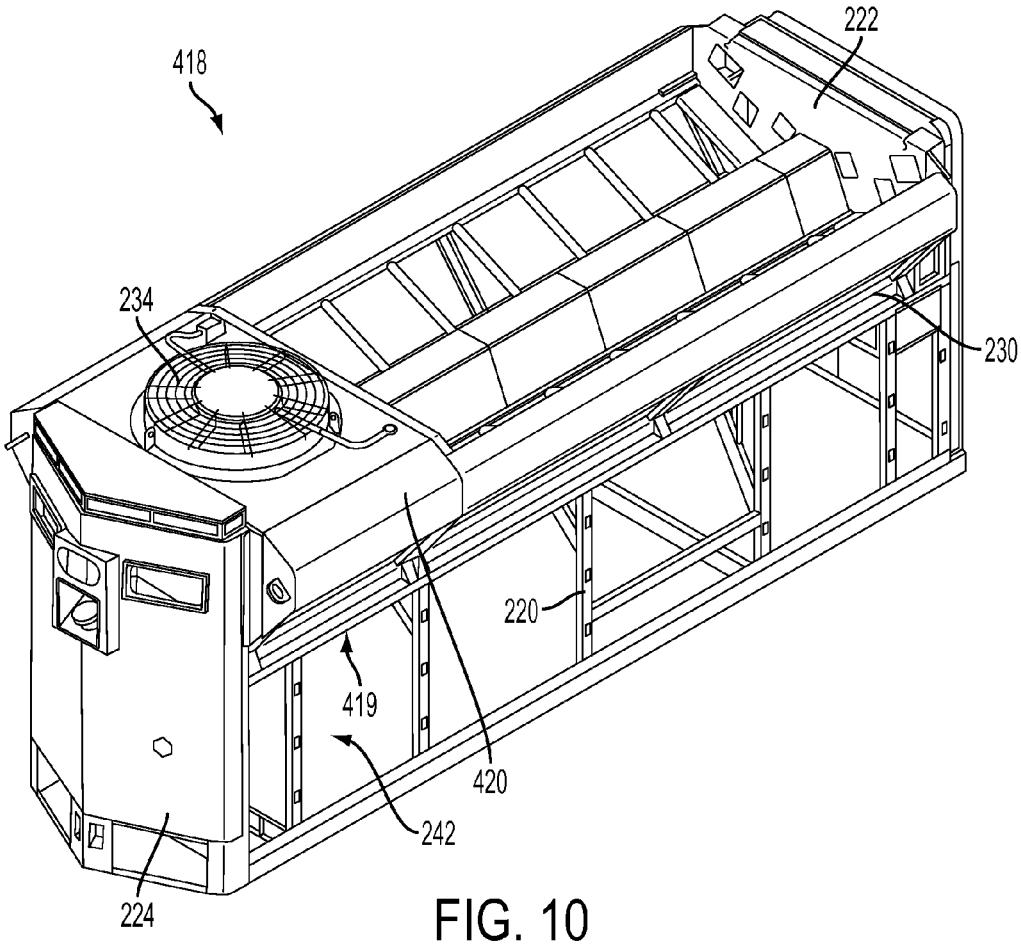
FIG. 10 is a perspective view of the engine compartment of another alternative embodiment for a locomotive in accordance with the disclosure.
Figure 11:
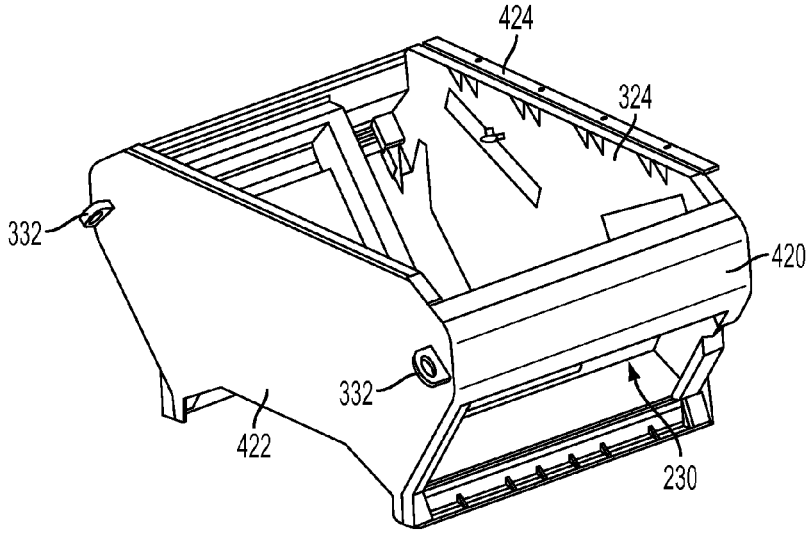
FIG. 11 is a perspective view of a removable cap for a locomotive in accordance with the embodiment shown in FIG. 10.
Figure 12:
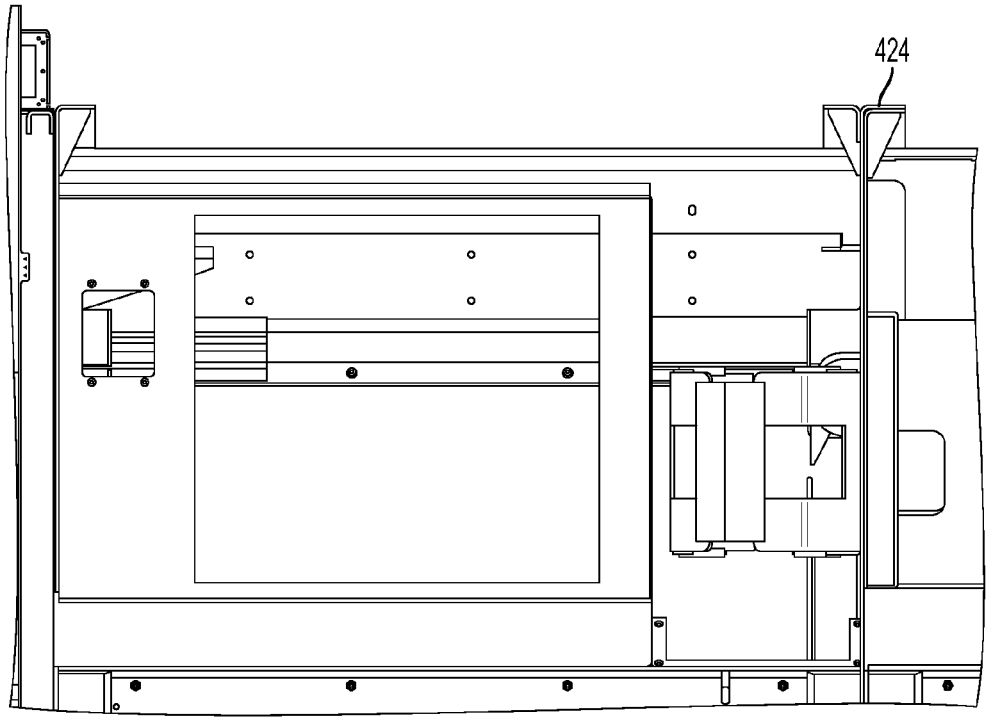
FIG. 12 is a cross section through a portion of the engine compartment shown in FIG. 10.
Figure 13:
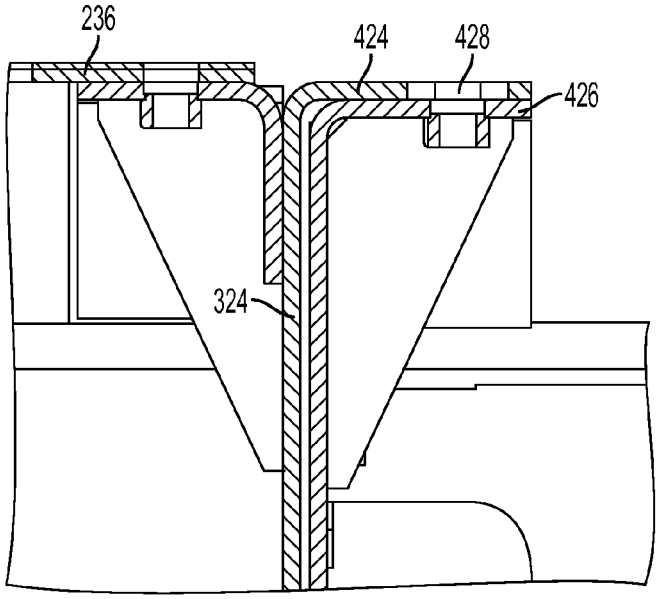
FIG. 13 is a detail cross section thereof.

Although the end structure 224 is higher for the engine compartment 418 than it is for the engine compartment 318, the engine compartment 418 includes a removable cap 420 that is structured generally similarly to the removable cap 320, as shown in FIGS. 7 and 8. The removable cap 420 also has a generally rectangular cuboid or box shape. More specifically, as shown in FIG. 11, the removable cap 420 includes a rear structure panel 422 that is disposed adjacent the rear structure 224 when the cap 420 is installed as part of the engine compartment 418. The removable cap 420 further includes an inner structure plate 324 that mates with the remaining engine compartment and two radiators (not shown) disposed at an angle that follows the profile of the radiators 230 of the main engine, as shown in FIG. 10. A fan 234 is connected at the top of the removable cap 420 and configured to convectively cool the radiators as in the previous embodiments.

The removable cap 420 further includes a flange 424 disposed along the upper, laterally extending edge of the inner structure plate 324 such that the overall profile of the engine compartment appears uninterrupted when the removable cap 420 is installed. As best shown in the cross sections of FIGS. 12 and 13, the flange 424 is formed as part of the inner structure plate 324 and extends perpendicularly away therefrom such that it rests on a top engine enclosure structure 426. The flange 424 is connected to the top engine enclosure structure 426 by fasteners (not shown) extending through bores 428. In this way, any gaps that may remain in the vertical direction between the removable cap 420 and the remaining structure of the engine compartment 418 will be on the lower or sandbox end of the enclosure and will not detract from the aesthetic appearance of the locomotive engine enclosure.

From a functional standpoint, the removable cap 420 supports the fan 234 and radiators 230 in a fashion similar to the engine compartment 218 and hatches 236 and 240 discussed previously relative to the embodiment shown in FIGS. 2-5. Yet, even with the increased height, the end structure 224 will not substantially interfere with the removal of the engine 228 through the engine pit opening 238. After the engine 228 has been lifted beyond a top clearance level at the side edges 419 (also shown in FIG. 9) of the engine pit opening 238, the engine may be laterally moved away from the locomotive even before the end structure 224 has been cleared. In other words, the engine removal can be accomplished with the relative ease previously described relative to the removable cap 320 as shown in FIG. 9. In this way, the locomotive 100 may be more easily serviced in facilities having lower overhead cranes or overhead work clearance. In the illustration of FIG. 9, the engine 228 is shown in a partially withdrawn position as it passes through the engine pit opening 238.

Industrial Applicability

The present disclosure is applicable to locomotives having multiple engines driving generators or gensets. The various embodiments described herein generally include structures disposed above an engine that can be removed such that the engine can be extracted from the locomotive. Given the relatively tight clearances around the engines disposed in the engine compartment of the locomotive, engine extraction can shorten the time spent servicing the engine by providing easy access to engine components.

Figure 14:
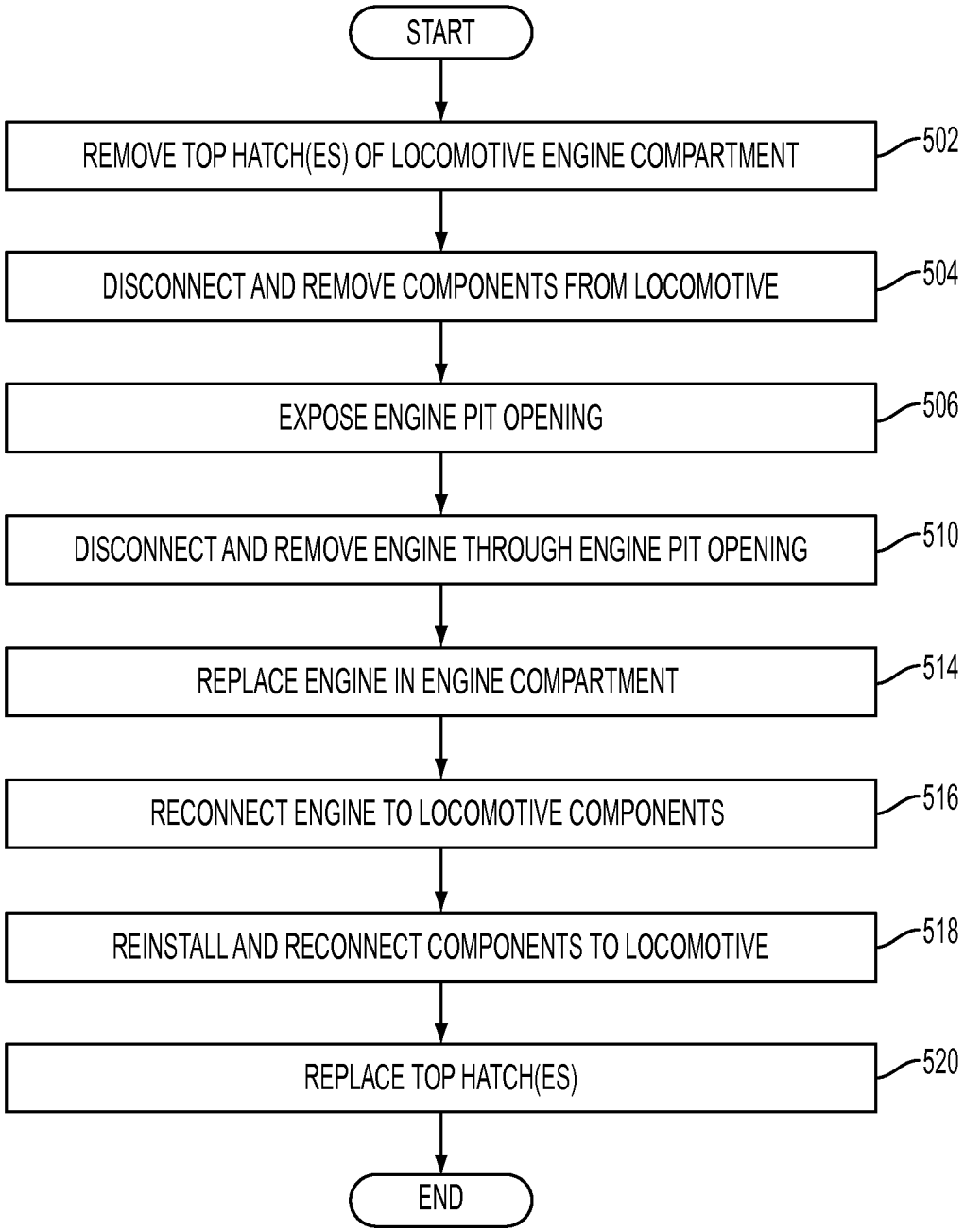
FIG. 14 is a flowchart for a method in accordance with the disclosure.

A flowchart for a method of servicing an engine of a locomotive is shown in FIG. 14. Certain engine service procedures may be conducted that require access to hard-to-reach engine components when the engine is installed in the locomotive. In such instances, a service procedure may begin by removing one or more top hatches of an engine compartment of the locomotive at 502. Various components of the locomotive, such as fans, radiators and the like that are installed on the top of the engine compartment are disconnected and removed at 504. The removal of these components exposes an engine pit opening at 506. The engine pit opening is an opening through the top of the engine compartment having sufficient clearance to allow the lifting and removal of a locomotive engine from the engine compartment.

The engine exposed from the top through the engine pit opening may be disconnected from other components and systems of the locomotive, lifted through the engine pit opening and removed from the locomotive at 510. Following the completion of service procedures on the engine removed or, alternatively, replacement of the engine, the engine is replaced in the engine compartment by lowering into position through the engine pit opening at 514. The engine is reconnected to the appropriate components and systems of the locomotive at 516, various other components removed at 504 are reinstalled and reconnected at 518, and the top hatches of the engine compartment are replaced at 520 to complete the service procedure.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A locomotive, comprising:

a frame having a longitudinally extending centerline, the frame supported by two trucks having traction motors associated therewith, the traction motors operable to drive one or more wheels configured to engage a railroad;

an engine compartment having two sidewall structures extending parallel to the centerline, an inboard end structure and a rear end structure, the inboard and rear end structures extending perpendicular to the centerline;

an engine enclosure defined between the frame, the two sidewall structures, and the inboard and rear end structures;

at least one top hatch connected to the engine compartment and disposed to cover a top opening of the engine enclosure;

at least one engine connected to a generator and disposed within the engine enclosure, the generator configured to provide electrical power to the traction motors;

a removable cap being generally box-shaped and extending across a portion of the top opening of the engine enclosure adjacent the at least one top hatch and across a portion of each of the two sidewall structures;

an engine pit opening defined in the engine enclosure and exposed when the removable cap has been removed, the engine pit opening being sufficiently large to accommodate the at least one engine being lifted out of the engine enclosure through the engine pit opening;

wherein the engine pit opening is further defined by two side edges extending parallel to the centerline along the sidewall structures, each of the two side edges disposed at a clearance height that is lower than an overall height of the engine compartment.

2. The locomotive of claim 1, wherein the removable cap further includes:

a radiator associated with a cooling system of the at least one engine, the radiator connected to a sidewall portion of the removable cap, and a fan connected to a top hatch portion of the removable cap and configured to provide an airflow through the radiator, wherein the radiator and the fan are removable from the locomotive along with the removable cap.

3. The locomotive of claim 2, wherein the removable cap further includes a rear structure portion aligned with the rear end structure and extending vertically upward therefrom, such that the engine pit opening is further defined by a rear edge disposed at the clearance height.

4. The locomotive of claim 1, wherein the removable cap further includes a flange disposed along an upper, laterally extending edge of an inner structure plate such that an overall profile of the engine compartment appears uninterrupted when the removable cap is installed.

5. The locomotive of claim 4, wherein the flange is formed as part of the inner structure plate and extends perpendicularly away therefrom such that it rests on a top engine enclosure structure such that any gaps that may remain in a vertical direction between the removable cap and the engine enclosure will be disposed on a lower end of the engine enclosure.

6. The locomotive of claim 1, wherein the at least one engine and the generator are a genset.

7. The locomotive of claim 1, wherein each of the two sidewall structures includes a plurality of door openings, each door opening having a door configured to close a respective door opening.

8. An engine compartment for housing one or more engines of a machine, the engine compartment comprising:

two sidewall structures extending parallel to a longitudinal centerline of the engine compartment;

an inboard end structure and a rear end structure extending perpendicular to the centerline;

an engine enclosure defined between the frame, the two sidewall structures, and the inboard and rear end structures;

at least one top hatch disposed to cover a top opening of the engine enclosure;

at least one engine disposed within the engine enclosure;

a removable cap being generally box-shaped and extending across a portion of the top opening of the engine enclosure adjacent the at least one top hatch and across a portion of each of the two sidewall structures;

an engine pit opening defined in the engine enclosure and exposed when the removable cap has been removed, the engine pit opening being sufficiently large to accommodate the at least one engine being lifted out of the engine enclosure through the engine pit opening;

wherein the engine pit opening is further defined by two side edges extending parallel to the centerline along the sidewall structures, each of the two side edges disposed at a clearance height that is lower than an overall height of the engine compartment.

9. The engine compartment of claim 8, wherein the removable cap further includes:

a radiator associated with a cooling system of the at least one engine, the radiator connected to a sidewall portion of the removable cap, and a fan connected to a top hatch portion of the removable cap and configured to provide an airflow through the radiator, wherein the radiator and the fan are removable from the engine compartment along with the removable cap.

10. The engine compartment of claim 9, wherein the removable cap further includes a rear structure portion aligned with the rear end structure and extending vertically upward therefrom such that the engine pit opening is further defined by a rear edge disposed at the clearance height.

11. The engine compartment of claim 8, wherein the removable cap further includes a flange disposed along an upper, laterally extending edge of an inner structure plate such that an overall profile of the engine compartment appears uninterrupted when the removable cap is installed.

12. The engine compartment of claim 11, wherein the flange is formed as part of the inner structure plate and extends perpendicularly away therefrom such that it rests on a top engine enclosure structure such that any gaps that may remain in a vertical direction between the removable cap and the engine enclosure will be disposed on a lower end of the engine enclosure.

13. The engine compartment of claim 8, further including a generator connected to the at least one engine, wherein the at least one engine and the generator are a genset.

14. The engine compartment of claim 8, wherein each of the two sidewall structures includes a plurality of door openings, each door opening having a door configured to close a respective door opening.

15. A method for servicing a locomotive engine, the method comprising:

removing one or more top hatches of an engine compartment of the locomotive;

disconnecting and removing various components of the locomotive that are installed on a top portion of the engine compartment;

exposing an engine pit opening through a top of the engine compartment, the engine pit opening having sufficient clearance to allow the lifting and removal of a locomotive engine from the engine compartment, wherein the engine pit opening is at least partially defined by two side edges extending parallel to a centerline of the locomotive, each of the two side edges disposed at a clearance height that is lower than an overall height of the engine compartment;

disconnecting the locomotive engine from other components and systems of the locomotive; and lifting and removing the locomotive engine from the locomotive through the engine pit opening.

16. The method of claim 15, further comprising replacing and reinstalling the engine to the locomotive through the engine pit opening.

17. The method of claim 15, wherein exposing the engine pit opening includes removing a removable cap covering the engine pit opening from the locomotive, the removable cap having a generally box-shape that extends along the top portion of the engine compartment adjacent the one or more top hatches of the engine compartment.

18. The method of claim 17, wherein the removable cap further extends over each of the two side edges.

19. The method of claim 15, wherein the engine pit opening is at least partially defined by a rear edge extending between the two side edges along a direction that is perpendicular to the longitudinal centerline, wherein the rear edge is disposed at the clearance height.

20. The method of claim 15, wherein the various components include a fan and at least one radiator, and wherein the fan and the at least one radiator are connected to the removable cap such that they are removed there along from the locomotive.

* * * * *